US007396002B1

(12) United States Patent
Gibbs

(10) Patent No.: US 7,396,002 B1
(45) Date of Patent: Jul. 8, 2008

(54) TERRAIN-ADJUSTABLE BRACKET

(76) Inventor: Edward L. Gibbs, 1555 N. Mingo Rd., Tulsa, OK (US) 74106

( * ) Notice: Subject to any disclaimer, the term of this patent is extended or adjusted under 35 U.S.C. 154(b) by 0 days.

(21) Appl. No.: 11/689,589

(22) Filed: Mar. 22, 2007

Related U.S. Application Data

(60) Provisional application No. 60/747,367, filed on May 16, 2006.

(51) Int. Cl.
*E04H 17/14* (2006.01)

(52) U.S. Cl. ..... 256/67; 256/65.08

(58) Field of Classification Search ..... 256/65.08, 256/67; 52/655.1, 656.9, 702, 712; 16/390–392
See application file for complete search history.

(56) References Cited

U.S. PATENT DOCUMENTS

| | | | | |
|---|---|---|---|---|
| 2,563,530 | A | 8/1951 | Hawkins | |
| 2,818,871 | A * | 1/1958 | Beaudry | 24/16 PB |
| 3,005,623 | A * | 10/1961 | Kusel et al. | 256/67 |
| 3,067,985 | A | 12/1962 | Cusack | |
| 4,360,285 | A * | 11/1982 | Magness | 403/187 |
| 4,850,214 | A | 7/1989 | Opprecht et al. | |
| 5,136,813 | A | 8/1992 | Gibbs et al. | |
| 5,272,838 | A | 12/1993 | Gibbs | |
| 5,345,723 | A | 9/1994 | Gibbs | |
| 5,391,049 | A * | 2/1995 | Reschlein | 16/392 |
| 5,443,244 | A | 8/1995 | Gibbs | |
| 5,913,508 | A * | 6/1999 | Eades | 256/67 |
| 6,176,043 | B1 | 1/2001 | Gibbs | |
| 6,254,064 | B1 | 7/2001 | Gibbs | |
| D465,856 | S | 11/2002 | Givens et al. | |
| D466,620 | S | 12/2002 | Givens et al. | |

(Continued)

FOREIGN PATENT DOCUMENTS

| | | | |
|---|---|---|---|
| DE | 3716343 | A1 | 12/1988 |

(Continued)

OTHER PUBLICATIONS

Ameristar Fence Products, Inc., "Aegis II Ornamental Fence & TransPort Ornamental Gates," pp. 1-16, published in the United States in Aug. 1999.

(Continued)

*Primary Examiner*—Victor MacArthur
(74) *Attorney, Agent, or Firm*—Gary Peterson

(57) ABSTRACT

A bracket is formed from a channel-shaped lower section adapted for attachment to the post, and a channel-shaped upper section pivotably joined to the lower section at its upper end. The bracket is used in fence assembly to connect the end of a channel-shaped rail and a post. The upper section may be pivoted with respect to the lower section, as required to align the upper section with the terrain upon which the rail and post are to be installed. The upper section and lower sections of the bracket cooperate to define a pair of spaced pockets adapted to receive the spaced side walls of a rail. Engagement of the side walls of the upper section of the bracket with internally projecting longitudinal ridges in the rail channel interfere with lifting of the rail from the bracket. Externally projecting tabs on the side walls of the upper section interfere with longitudinal withdrawal of the rail from the bracket.

18 Claims, 7 Drawing Sheets

U.S. PATENT DOCUMENTS

| | | | | |
|---|---|---|---|---|
| D467,669 | S | 12/2002 | Givens et al. | |
| D468,028 | S | 12/2002 | Givens et al. | |
| 6,491,286 | B1 * | 12/2002 | Hadfield et al. | 256/65.08 |
| 6,739,583 | B2 | 5/2004 | Ryon | |
| 6,811,145 | B2 | 11/2004 | Gibbs et al. | |
| 6,874,767 | B1 | 4/2005 | Gibbs | |
| 6,969,051 | B1 | 11/2005 | Gibbs | |
| 7,071,439 | B2 | 7/2006 | Gibbs et al. | |
| 7,086,642 | B1 | 8/2006 | O'Brien | |
| 7,090,202 | B1 | 8/2006 | O'Brien | |
| 7,159,853 | B2 | 1/2007 | Gibbs et al. | |
| 2003/0066996 | A1 * | 4/2003 | Cook et al. | 256/65.15 |
| 2005/0199864 | A1 | 9/2005 | Gibbs et al. | |

FOREIGN PATENT DOCUMENTS

| | | |
|---|---|---|
| JP | 53-69439 | 6/1978 |

OTHER PUBLICATIONS

Ameristar Fence Products, Inc., "Aegis II Industrial & Aegis Plus Commercial Ornamental Steel Fence and TransPort Ornamental Gates," pp. 1-18, published in the United States in Aug. 2000.

Ameristar Fence Products, Inc., "Aegis Ornamental Steel Residential Fencing," pp. 1-8, published in the United States no later than Apr. 2001.

Ameristar Fence Products, Inc., "2002 Price Catalog," all pages, published in the United States by at least Nov. 1, 2001 (prices redacted).

* cited by examiner

TERRAIN-ADJUSTABLE BRACKET

CROSS-REFERENCE TO RELATED APPLICATION

This application is a non-provisional of, and claims the benefit of the filing date of, U.S. Provisional Patent Application Ser. No. 60/747,367, filed May 16, 2006, the entire disclosure of which is incorporated by reference.

BACKGROUND OF THE INVENTION

The present invention relates to brackets for installation of fences and fence components.

SUMMARY OF THE INVENTION

The present invention comprises a bracket for connecting the end of a channel-shaped rail and a post. The bracket comprises a lower section and an upper section. The lower section has upper and lower ends, and is adapted for attachment to the post. The upper section is pivotably joined to the lower section at its upper end, has opposed sides walls, and is sized to be longitudinally receivable within the channel of the rail.

The present invention further comprises a barrier formed from a plurality of posts, a plurality of channel-shaped rails and a plurality of brackets for securing each end of each rail to an adjacent post. Each post is embedded at its base within an underground substrate. The plurality of rails are disposed in spaced and parallel relationship. Each rail has a web and opposed side walls and extends between an adjacent pair of posts. Each bracket is formed from a lower section and an upper section. The lower section has upper and lower ends, and is adapted for attachment to the post. The upper section is pivotably joined to the lower section at its upper end, has opposed sides walls, and is sized to be longitudinally receivable within the channel of the rail.

BRIEF DESCRIPTION OF THE DRAWINGS

FIG. 5 is a side elevational view of the bracket shown in FIG. 4, taken along line 5-5.

FIG. 6 is a top plan view of the bracket shown in FIG. 4, taken along line 6-6.

DETAILED DESCRIPTION

Figure 1:
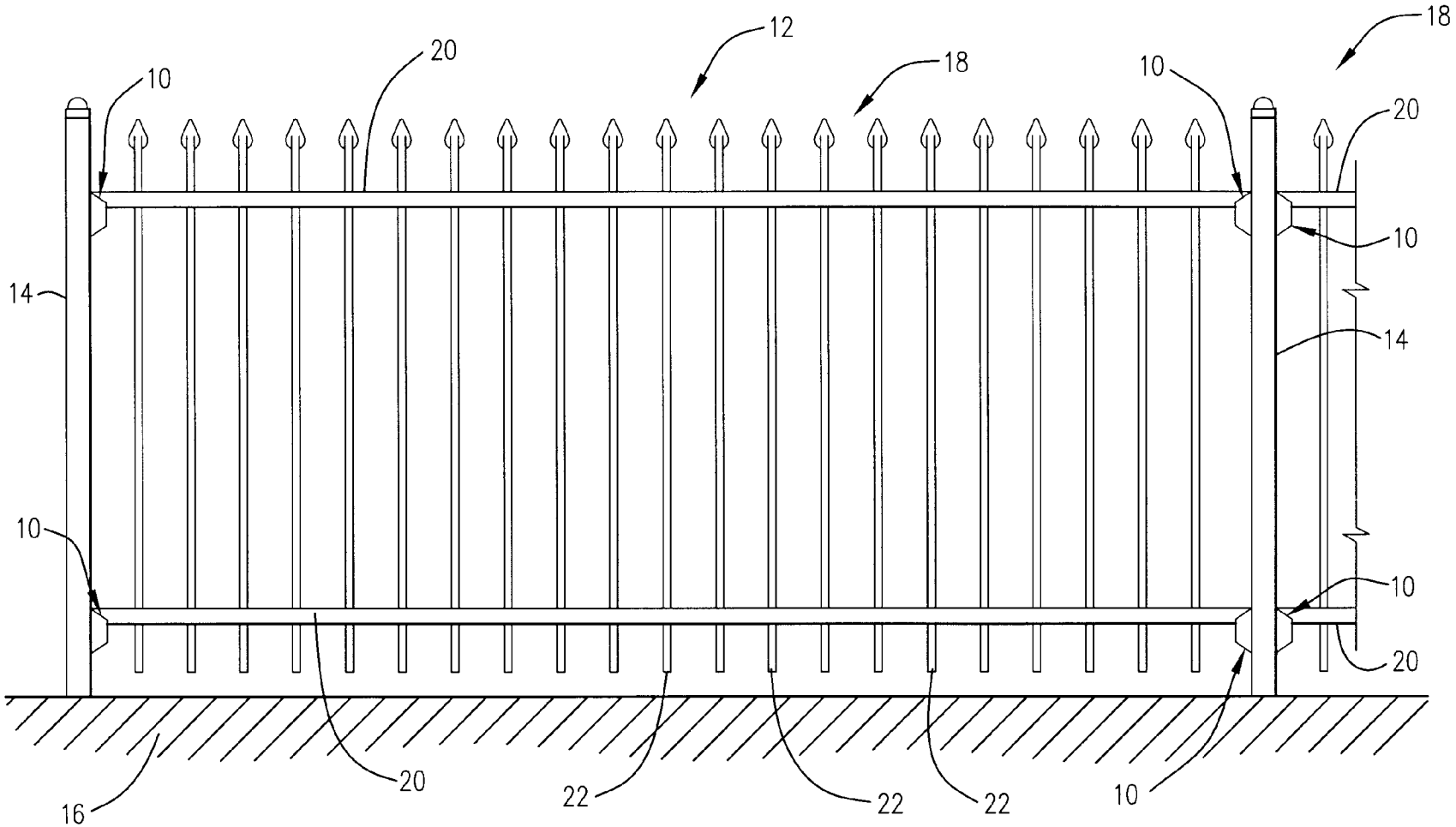
FIG. 1 shows a fence incorporating the brackets of the present invention, configured to conform to a substantially horizontal terrain. The terrain is shown in cross-section.
Figure 3:
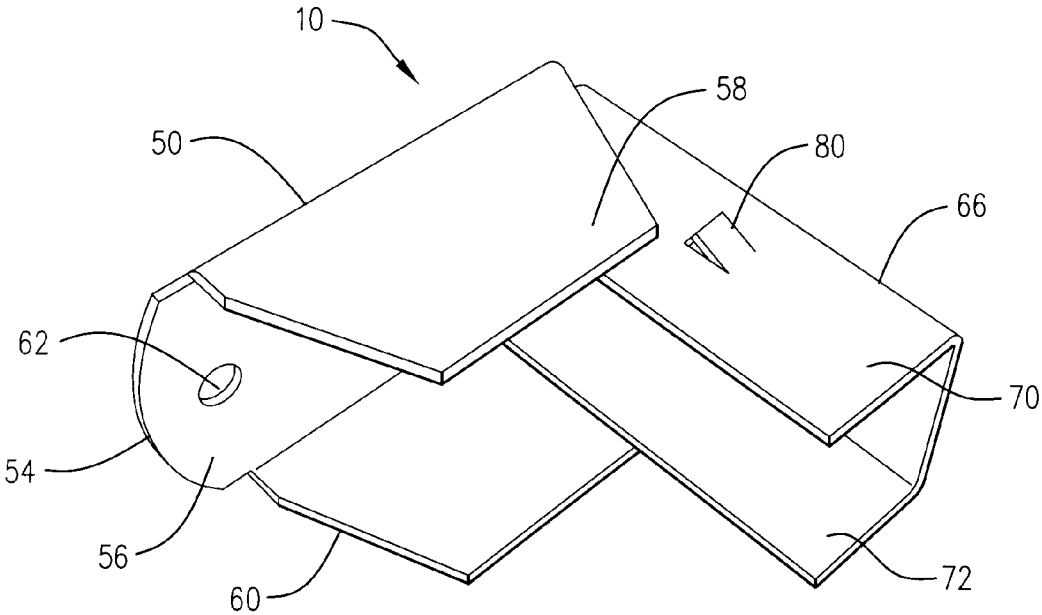
FIG. 3 is a perspective view of the bracket of the present invention.
Figure 4:
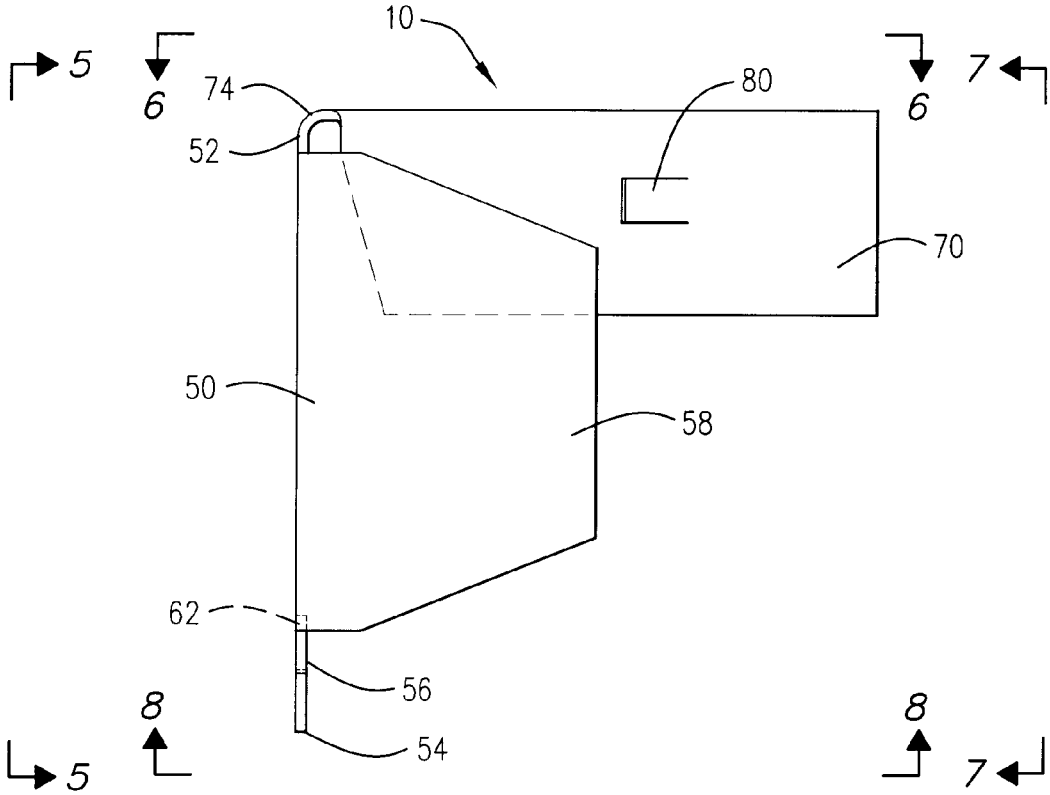
FIG. 4 is a front elevational view of the bracket of the present invention.
Figure 3:
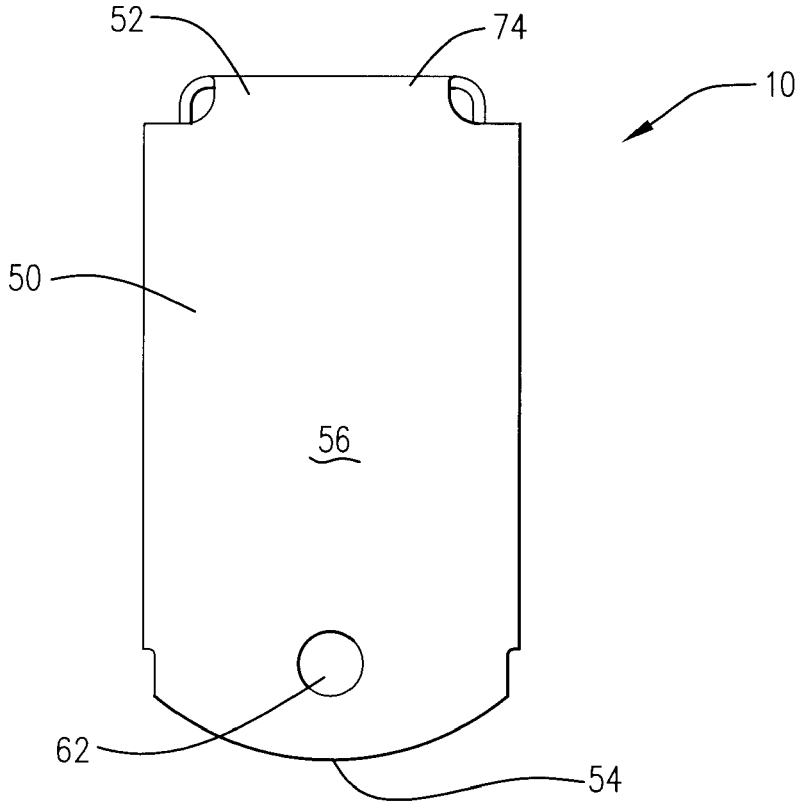
Figure 4:
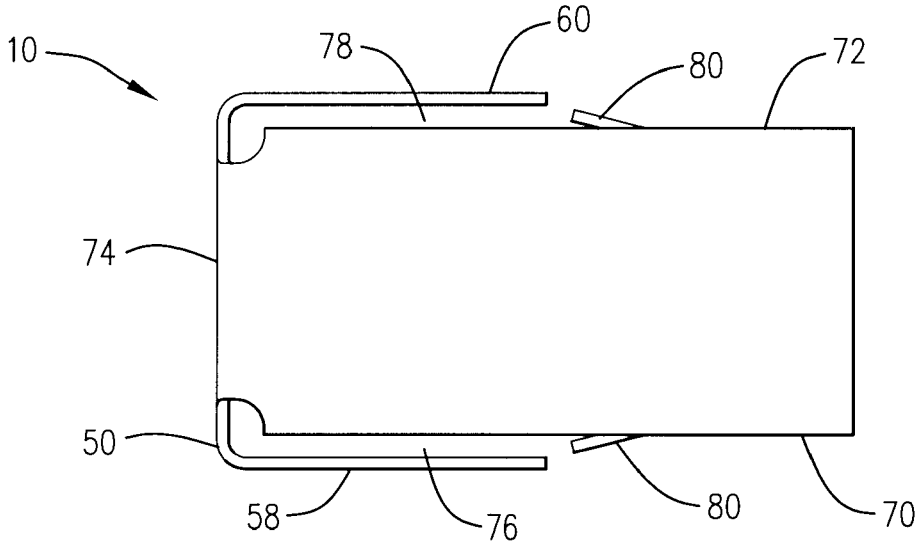
Figure 7:
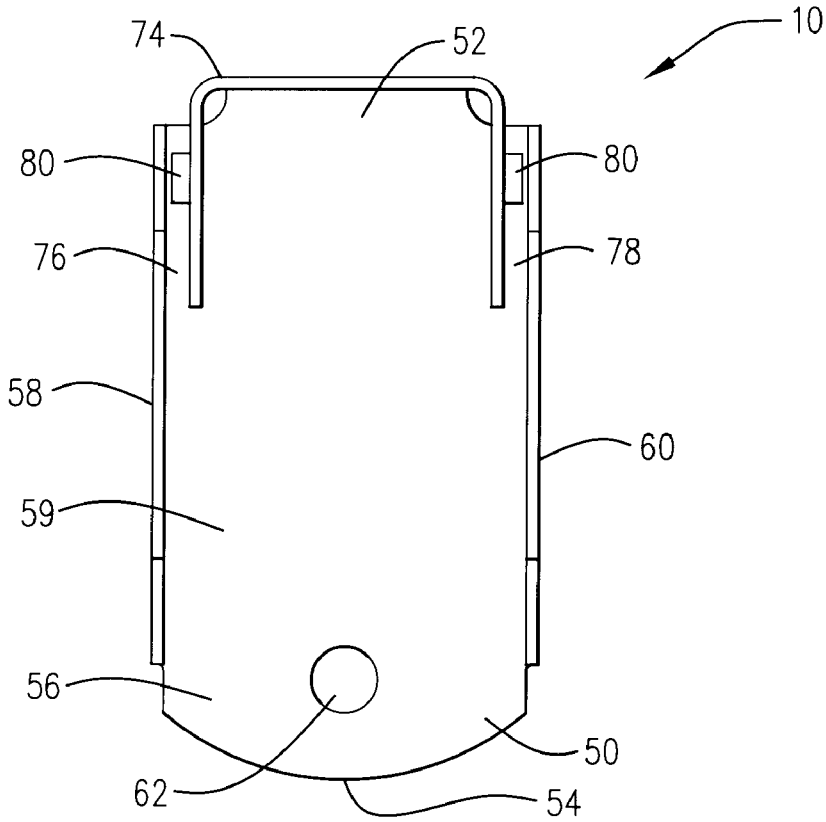
FIG. 7 is a side elevational view of the bracket shown in FIG. 4, taken along line 7-7.

With reference to FIGS. 1 and 3, the present invention comprises a bracket 10 for use in a barrier, such as a fence, balustrade, or gate, formed from at least one, and preferably a plurality of, elongate rails, and at least one, and preferably a plurality, of upright members, such as pickets. FIG. 1 shows such a barrier as embodied in a fence, generally designated by reference numeral 12.

The fence 12 preferably comprises a plurality of spaced posts 14, preferably identical in construction, each of which is securely anchored at its base into a substrate 16, such as the ground or an underground mass of concrete. The posts 14 are preferably vertical. As used herein, "vertical" should be understood to designate a direction parallel to the earth's gravity. The posts 14 are situated along the boundary of the area to be enclosed by the fence 12, with a post spacing that is adequate to impart strength to the fence 12 and to securely anchor other fence components. In the FIG. 1 embodiment, a post separation distance of 8 feet would be typical.

Each post 14 is preferably formed from a strong and durable material, such as sheet steel, aluminum or a plastic such as polyvinyl chloride. If metal, the post 14 is preferably formed from a metal sheet. In one preferred embodiment, the sheet has a thickness of 0.059 inches. In order to enhance its resistance to corrosion, this sheet is preferably subjected to a pre-galvanizing treatment. The pre-galvanized sheet is then subjected to a cold rolling process to form the rail into a tubular configuration, preferably having a polygonal, most preferably rectangular, cross-section. Alternately, the post may be formed with a circular cross-section. After cold rolling is complete, a polyester powder coating is preferably provided in order to further enhance corrosion resistance of the post 14.

With continued reference to FIG. 1, the fence 12 may be formed from a plurality of panels 18, each of which may function as a barrier. Preferably, panel 18 is modular in character. Each panel 18 is supported by, and extends between, an adjacent pair of posts 14, and is formed from at least one rail 20, and at least one upright member 22. More preferably, each panel 18 is formed from a plurality of spaced and parallel rails 20, and a plurality of spaced and parallel upright members 22, such as the pickets shown in FIG. 1. The upright members 22 forming each panel 18 preferably extend in substantially perpendicular relationship to the rails 20 forming that panel 18, subject to angular adjustment as described hereafter.

While any number of rails may be provided for each panel 18, either two rails, as shown in FIG. 1, or three rails, are preferred. The number of upright members 22 provided for each panel 18 should be sufficiently great to assure that the separation distance between adjacent upright members 22, or between a post 14 and an adjacent upright member 22, will not permit an intruder to travel between them. For example, in a panel to be installed between posts, which are separated by an 8-foot distance, twenty-one upright members may be provided, with a uniform separation distance of 4.334 inches.

Figure 11:
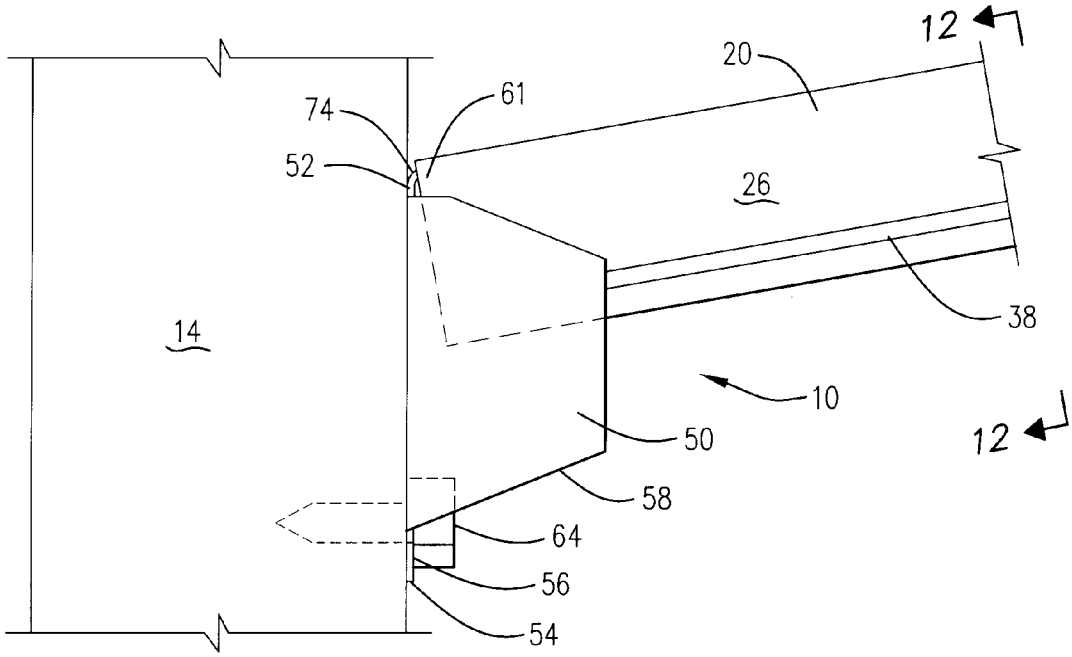
FIG. 11 is a front elevational view of a rail installed on the bracket shown in FIG. 10.
Figure 12:
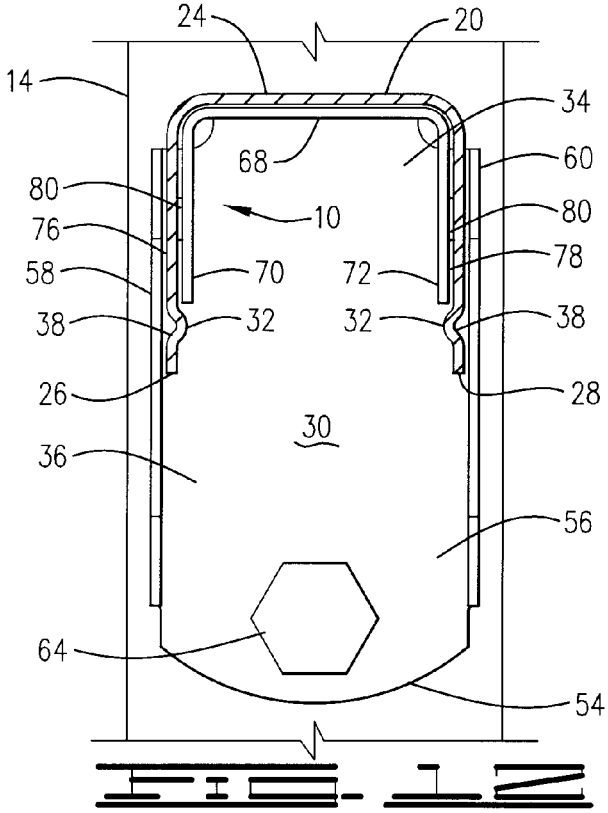
FIG. 12 is a cross-sectional view of the rail-bracket assembly shown in FIG. 11, taken along line 12-12. The post has been omitted, in order to better display other components.

As best shown in FIGS. 11 and 12, each rail 20 is preferably characterized by an elongate web 24, which is preferably flat, and a pair of spaced and opposed side walls 26 and 28, which extend from the web 24, and preferably from the opposite lateral edges thereof. The web 24 and side walls 26 and 28 collectively define a U-shaped rail channel 30. The length of each rail 20 should be sufficient to fully span the distance between the adjacent of pair of posts 14 which will support that rail, or support the panel 18 into which the rail will be incorporated.

Each rail 20 is preferably formed from a strong and durable material, such as sheet steel, aluminum, or a plastic such as polyvinyl chloride. When the rail 20 is to be subjected to a resistance welding process, as described hereafter, the rail 20 should be formed from a conductive metal. If metal, the rail 20 is preferably formed from a metal sheet. In one preferred embodiment, the sheet has a thickness of 0.075 inches. In order to enhance its resistance to corrosion, this sheet is preferably subjected to a pre-galvanizing treatment. The pre-galvanized metal sheet is then subjected to a cold rolling process to produce the cross-sectional shape shown in FIG. 12.

Preferably at least one, and more preferably both, of the side walls 26 and 28 include a region 32 which projects within the rail channel 30. In the embodiment of the rail 20 shown in FIG. 12, a projecting region has been formed in each side wall. Each projecting region 32 may comprise, for example, a ridge that extends along at least a portion of its respective side wall, preferably longitudinally with respect to the rail, and more preferably in substantially parallel relationship to the longitudinal axis of the rail 20. Most preferably, each ridge extends continuously along substantially the entire length of its associated side wall The projecting regions 32 function to separate the rail channel 20 into an upper portion 34 and a lower portion 36, with the regions 32 defining the boundary therebetween.

When the rail 20 is formed from metal, and when the projecting regions comprise ridges, the ridges are preferably formed during the cold rolling process. One or more indentations 38, such as continuous longitudinal scores, are preferably formed in the surface of the sheet that will not define and be contiguous to the rail channel 30. These scores cause ridges to protrude from the opposite surface of the sheet. When that surface is formed into the rail channel 30 by the cold rolling process, each of the protrusions will define an elongate ridge which projects within the rail channel 30 and comprises a projecting region 32, as shown in FIG. 12. The score or other indentations 38 formed on the side wall surface opposite the projecting regions 32 functions to impart enhanced strength for the rail 20.

When the rail 20 is formed from a sheet having a thickness of 0.075 inches, a preferred height for the region 32, with respect to its associated side wall, is 0.035 inches. A preferred width for the region 32 is 0.143 inches. A pointed and or angular profile for the region 32 is preferred. Further details about the formation and characteristics of the projecting regions 32 are found in U.S. Pat. No. 6,811,145, the entire disclosure of which is incorporated by reference.

A plurality of longitudinally spaced top openings (not shown) are preferably also formed in the web 24 of at least one of the rails 20, more preferably in all of the rails 20, with the possible exception of the uppermost rail 20. In the embodiment shown in FIG. 1, top openings are formed in all of the rails 20. Preferably, the top openings are formed by punching the sheet used to form the rail 20, before that sheet undergoes the cold rolling process used to form the rail 20. The top openings should be characterized by identical size and shape, which preferably is rectangular. Each top opening should be characterized by at least one rectilinear edge. Other features of the structure and formation of the top openings will described hereafter.

Each upright member 22 is preferably formed from a strong and durable material, such as sheet steel, aluminum or a plastic such as polyvinyl chloride. When the upright member 22 is to be subjected to a resistance welding process, as described hereafter, the upright member 22 should be formed from a conductive metal. If metal, the upright member 22 is preferably formed from a metal sheet. In one preferred embodiment, the sheet has a thickness of 0.040 inches. In order to enhance its resistance to corrosion, this sheet is preferably subjected to a pre-galvanizing treatment. The pre-galvanized sheet is then subjected to a cold rolling process to form the upright member into a tubular configuration, preferably having a rectangular cross-section.

Each of the upright members 22 is preferably sized to be closely but clearingly received within the rail channel 30 of each rail 20, and to be clearingly received through any top openings formed in any of the rails 20 to which it will be attached. As shown in FIG. 1, the vertical height of each upright member 22 is preferably approximately equal to the above-ground vertical height of the posts 14. In the embodiment shown in FIG. 1, each upright member 22 is characterized by a substantially straight-line longitudinal axis. Alternately, each upright member may be characterized by a longitudinal axis having a lower portion that is straight, in the area of the point or points of attachment to the rail 20, and an upper portion that bends or curves away from the straight lower portion. When a plurality of upright members 22 is provided, they are preferably identical.

In the barrier of the present invention, each upright member 22 extends in transverse relationship to the rails 20 forming the barrier and traverses the rail channel 30 of each rail 20. Each upright member 22 is mechanically connected to each rail 20, such that the upright member 22 is selectively tiltable with respect to the rail 20 within an angular adjustment range. The angular adjustment range is preferably bilateral, extending on both sides of a transverse plane orthogonal to the rail 20. Relative tilting of each rail 20 and each upright member 22 preferably occurs around a rectilinear axis of rotation which extends transversely to the rail 20 and is situated at or adjacent the web 24 at its point of contact with upright member 22. When the rail 20 includes top openings, this axis preferably coincides with or is immediately adjacent to a rectilinear edge of the opening through which the upright member 22 extends. Further details about this feature of the invention are provided in U.S. Patent Publication No. 20050199864, the entire disclosure of which is incorporated by reference.

One limitation of some internally welded barriers is that the upright members or pickets are fixed in orientation with respect to the rail after the welding step is complete. The relative orientation of the welded pickets and rails, which is typically perpendicular, is maintained regardless of the slope upon which barrier is installed. For example, if such a barrier is installed on a 20 degree slope, the pickets of the barrier will not extend vertically, and will instead extend at a 20 degree angle to vertical. Such a picket configuration may be unacceptable from an aesthetic or functional standpoint.

In the present invention, on the other hand, the picket is tiltable with respect to the rail after mechanical connection between the rail and picket is formed, so that the picket can be tilted, if desired, with respect to the rail. If the barrier is installed on a slope, this feature will permit the pickets to be tilted to a vertical configuration, or a configuration parallel to posts 14, even though the rails of the barrier slope with respect to the horizontal in order to conform to the terrain.

Figure 2:
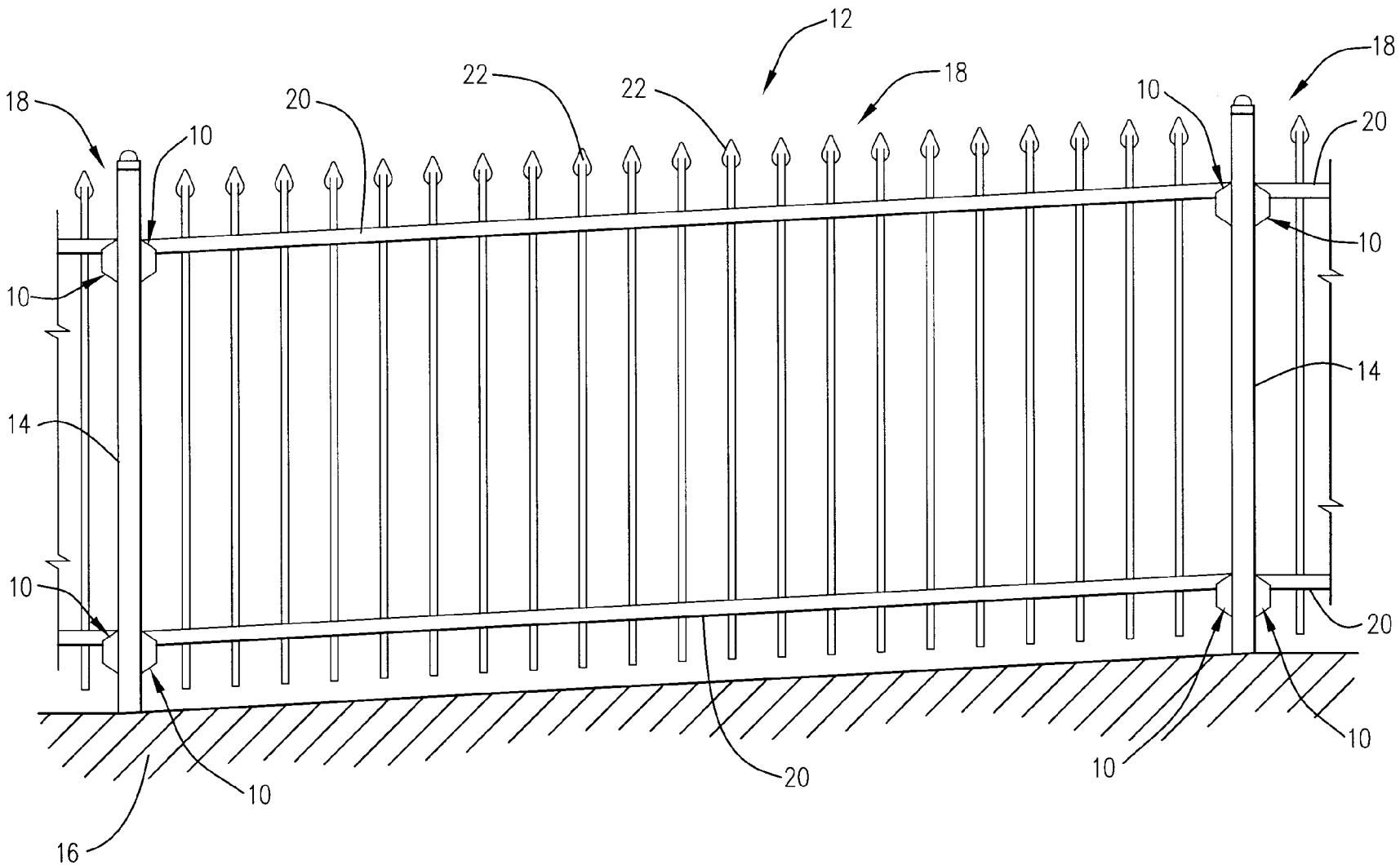
FIG. 2 shows a fence incorporating the brackets of the present invention, configured to conform to a sloping terrain. The terrain is shown in cross-section.

Preferably, the upright member 22 is tiltable within an angular adjustment range of up to a maximum angle of at least about 10 degrees, and preferably up to a maximum angle of at least about 20 degrees, in at least one direction from a transverse plane orthogonal (perpendicular) to rail 20. More preferably, as noted above, the angular adjustment range is fully bilateral, permitting tilting within such an angle in either direction from this transverse plane. By selective tilting of the upright member 22 within this angular adjustment range, the upright members 22 may be adjusted to a vertical position, or a position parallel to the posts 14, when the fence is installed on a sloping terrain 40, as shown in FIG. 2.

One preferred embodiment of the present invention involves a rail 20 having a length of between about 92 and about 94 inches. A preferred angular adjustment range permits the associated upright members 22 to be adjusted to a vertical position when the rail 20 is positioned on a sloping surface with a vertical rise of up to about 30 inches between the opposite ends of the rail 20. This extent of relative tilting requires an angular adjustment range of between about zero degrees and at least about 18 to 20 degrees, in one and preferably both directions about the transverse plane.

Within each panel 18, the incline of the rails 20 with respect to horizontal should substantially equal the incline of the terrain 40 on which the panel 18 is to be installed. Thus, when the fence 12 is positioned on horizontal terrain 40, as shown in FIG. 1, the rails 20 will be disposed substantially horizontally. If the terrain 40 is sloped, as shown in FIG. 2, the rails 20 should be oriented to follow that slope. Each rail 20 is disposed such that its channel 30 opens downwardly and such that its side walls 26 and 28 extend substantially vertically.

The bracket 10 of the present invention functions to connect the end of each rail 20 of each panel 18 to an associated post 14, such that the rail 20 assumes the correct incline with respect to the terrain 40. With reference to FIGS. 3-8, the bracket 10 comprises an lower section 50 adapted for attachment to a post 14, having an upper end 52 and a lower end 54. The lower section 50 is preferably channel-shaped, and characterized by a web 56, and a pair of spaced side walls 58 and 60 depending from opposite sides of the web 56. The web 56 and side walls 58 and 60 cooperate to define a channel 59, best shown in FIGS. 7 and 8. As shown in FIG. 11, the channel 59 is adapted to open away from the post 14, and is sized to transversely receive at least a portion of the end 61 of a rail 20.

Figure 9:
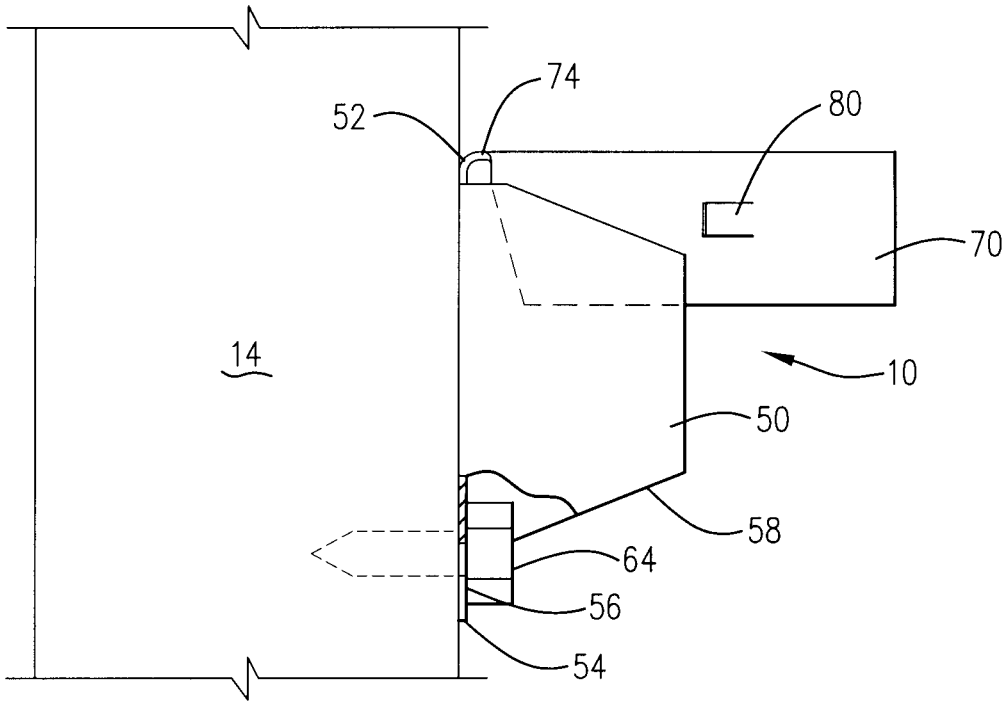
FIG. 9 is a front elevational view of the bracket of the present invention, in an installed position on a post.
Figure 10:
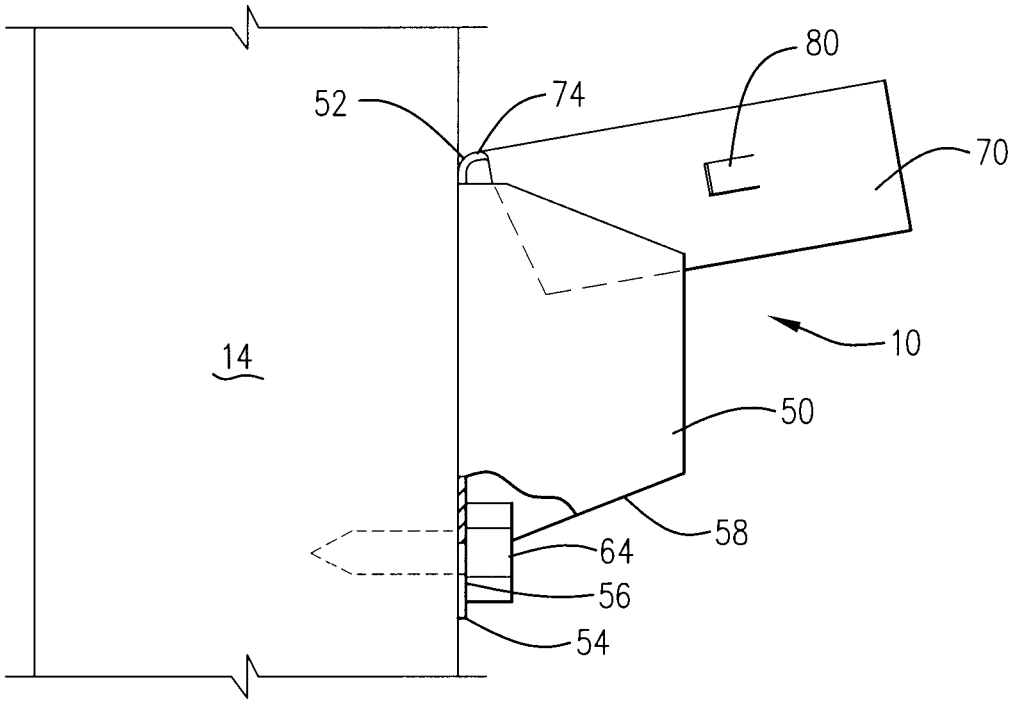
FIG. 10 is a front elevational view of the bracket of the present invention, in an installed position on a post. The upper portion of the bracket has been bent from the position shown in FIG. 9, to conform to the terrain.

The side walls 58 and 60 of the lower section 50 are preferably planar. In the embodiment shown in the Figures, each side wall is shaped as an isosceles trapezoid, with the parallel side most remote from the web 56 shorter than the parallel side adjacent the web 56. The side walls 58 and 60 may be configured in other shapes, such as rectangles. The web 56 should be shaped to conform to the external contour of the post 14 to which it will be attached. Thus, if the post 14 is polygonal, as in the Figures, the web 56 should be planar. On the other hand, if the post features a circular cross section, the web 56 will have an arcuate cross-section. An opening 62 is formed in the web 56, and is sized to receive a fastener 64, partially shown in FIGS. 9-11, that secures the bracket 10 to a post 14. The fastener 64 may constitute a bolt, screw, rivet or other connector. The fastener may also include a holder (not shown), such as a nut or collar.

The bracket 10 further comprises an upper section 66 pivotably joined to the lower section 50 at its upper end 52. The upper section 62 is preferably channel-shaped, and characterized by a web 68, and a pair of spaced side walls 70 and 72 depending from opposite sides of the web 68. Preferably, the web 68 and the side walls 70 and 72 are planar and rectangular in shape. As shown in FIG. 12, the upper section 66 should be sized to be longitudinally receivable within the channel 30 of the rail 20. More preferably, the upper section 66 of the bracket 10 is sized to be clearingly received within the upper portion 34 of the channel 20 of rail 20, as illustrated in FIG. 12.

Preferably, the upper and lower sections 50 and 66 of the bracket 10 are integral, with their junction comprising a bend 74 in the material from which the bracket 10 is formed. The bend 74 functions as a hinge, and permits the upper section 66 to be selectively titled with respect to the lower section 50 within an angular adjustment range, which is preferably at least as large as the angular adjustment range of the upright members 22.

Figure 8:
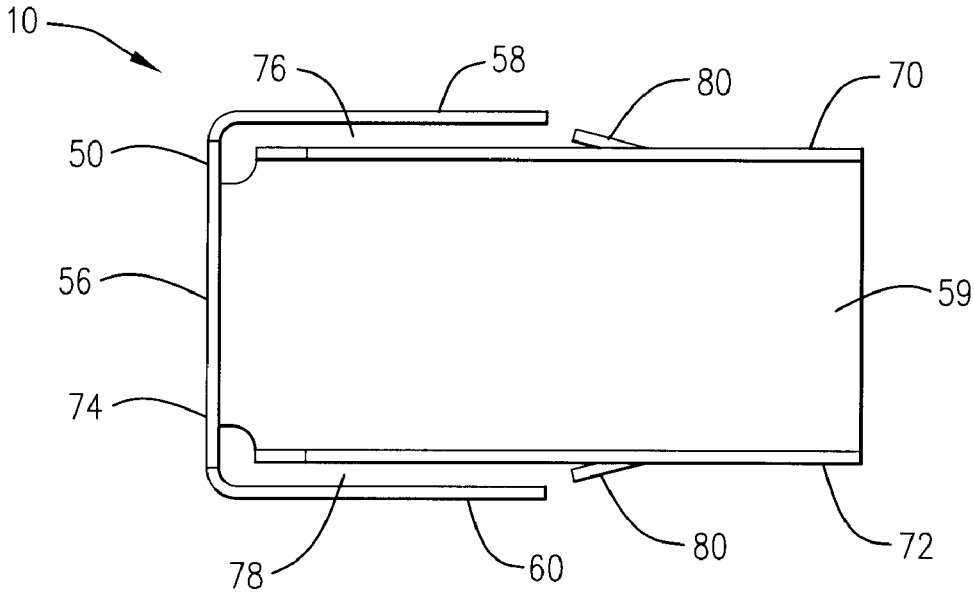
FIG. 8 is a bottom view of the bracket shown in FIG. 4, taken along line 8-8.

As best shown in FIGS. 6, 8 and 12, the upper section 66 and lower section 50 of the bracket 10 cooperate to define a pair of spaced pockets 76 and 78. The pocket 76 is situated between side wall 58 and side wall 70, while the pocket 78 is situated between side wall 60 and side wall 72. The web 56 functions as the base of each of the pockets 76 and 78. The pockets 76 and 78 are sized and adapted to respectively receive the spaced side walls 26 and 28 of the rail 20, as shown in FIG. 12.

With reference to FIGS. 4, 6, 7 and 8, an externally projecting tab 80 is formed in at least one side wall of the upper section 66, and preferably in each of the side walls 70 and 72. The tabs 80 are preferably situated outside the pockets 76 and 78. The tabs 80 are preferably rectangular in shape, and are formed by cutting three sides of a rectangle in the side wall and the bending the tab out around an axis coinciding with the fourth side. The included angle between tab 80 and its side wall is preferably acute, and opens toward the web 56. This configuration assures ease of insertion of the rail side walls 26 and 28 into their respective pockets 76 and 78.

The bracket 10 is preferably formed from a strong and durable material, such as stainless steel. The bracket is formed from a flat sheet of material. In order to enhance its resistance to corrosion, this sheet is preferably subjected to a pre-galvanizing treatment. A press or other tool is then used to cut the material to the required shape. A punch press or other tool is used to form opening 62, and cut three of the four sides of the rectangular shapes that will serve as tabs 80. The flat sheet is then bent, using a press or other tool into the configuration shown in FIGS. 3-8. Finally, a press or other tool is used to bend out the tabs 80 from the side walls 70 and 72.

In one preferred embodiment, for use with rails having a side wall height of 1.5 inches, and a web width of 1.4375 inches, the upper section of the bracket has a width of about 1.24 inches, a length of about 2.62 inches, and a side wall height of about 0.91 inches. The lower section of the bracket has a width of about 1.53 inches, a maximum length of about 2.95 inches, and a side wall height of about 1.30 inches.

When the brackets 10 are to be installed on posts 14 situated on horizontal terrain, as in FIG. 1, the web 68 and web 56 are preferably orthogonal, so as to define an included angle of 90 degrees. When the brackets 10 are to be installed between a pair of posts situated on sloping terrain, as in FIG. 2, the upper section 55 of the bracket 10 to be installed on the lower post 14 is pivoted, as by bending, with respect to its upper section 66 to define an included angle greater than 90 degrees, as shown in FIG. 11. The included angle should be selected such that the upper section 66 of the installed bracket 10 extends in substantially parallel relationship to the terrain 40, as shown in FIG. 2. The upper section of the bracket (not shown) to be installed on the uppermost of the pair of posts, is in turn pivoted to define an included angle that is supplementary to the included angle defined by the sections of the lower bracket. Such a configuration assures that upper bracket will likewise extend in parallel relationship to the terrain.

After the upper sections 66 of the brackets 10 have been pivoted, as necessary, to conform to the terrain, these brackets 10 should be installed on the rails 20 of the panel 18. A bracket 10 is installed on a rail 20 by causing the side walls 26 and 28 of rail 20 to move longitudinally into the pockets 76 and 78, such that the upper section 66 of the bracket 10 is received into the upper portion 34 of the channel 30 of rail 20.

In the installed position of the bracket 10, the web 68 of the upper section 50 closely adjoins the web 24 of rail 20, and at least a portion of the end of rail 20 abuts the web 56 of lower section 50. After the brackets 12 are installed on the rails 20, fasteners 64 are used to attach the web 56 of the lower section 50 of each bracket 10 to its associated post, thereby securing panel 18 between the adjacent pair of posts.

As FIG. 12 illustrates, the side walls 70 and 72 of the upper section 66 of the bracket 10 cooperate with the projecting ridges 32 of the rail 20 to interfere with lifting of a rail 20 from its associated bracket 10. Upward motion of the rail 20 will be obstructed when the ridges 32 engages the side walls 70 and 72 at their respective bases. The internal angle defined by tabs 80 should be selected so that the tabs 80 do not interfere with longitudinal insertion of rail 20 into bracket 10, but interfere with longitudinal withdrawal of a rail from bracket 10. Longitudinal withdrawal of a rail 20 will be resisted by engagement of the side walls 26 and 28 with the free end of each tab 80. The tabs 80 are thus adapted to interfere with longitudinal withdrawal of a rail 20 from its associated bracket 10.

In the embodiment shown in the Figures, the connection between the rail 20 and bracket 10 is maintained by the interference with separation provided by the internal ridges 32 of the rail and by the projecting tabs 80 of the bracket 10. In other embodiments, this connection could be maintained by fasteners, such as bolts, screws or rivets, or by welds or a permanent adhesive. Likewise, in the Figures, the rails 20 and upright members 22 have been assembled, prior to field installation of the fence 12, into prefabricated modular panels 18. In other embodiments, panels 18 may not be used, with rails 20 and upright members 22 instead undergoing assembly in the field.

Changes may be made in the construction, operation and arrangement of the various parts, elements, steps and procedures described herein without departing from the spirit and scope of the invention as described in the following claims.

The invention claimed is:

1. A kit comprising:

a plurality of posts;

a plurality of panels, each panel formed from a plurality of channel-shaped rails and a plurality of upright members extending in transverse relationship to the plural rails; and a plurality of brackets, each bracket, comprising:

a lower section formed from a pair of spaced first and second side walls interconnected by a web, the web and side walls cooperating to define a channel, the lower section having an upper end and a lower end; and an upper section partially received within the channel of the lower section and pivotably joined to the lower section at the upper end of the lower section, the upper section having opposed first and second side walls;

in which the first side walls of the upper and lower sections cooperate to define a first pocket, and the second side walls of the upper and lower sections cooperate to define a second pocket spaced from the first pocket, with each pocket sized to receive a side wall of a channel-shaped rail therein.

2. The kit of claim 1 in which the said channel in the lower section of the bracket is sized to transversely receive at least a portion of the end of said channel-shaped rail.

3. The kit of claim 1 in which an externally projecting tab is formed in a side wall of the upper section of the bracket.

4. The kit of claim 1 in which the upper and lower sections of the bracket are integral, and in which their junction comprises a bend in the material from which the bracket is formed.

5. The kit of claim 1 in which each rail is characterized as having a longitudinally extending ridge formed in each side wall so as to project within the rail channel, the ridges separating upper and lower portions of the rail channel, and in which the upper section of the bracket is sized to be clearingly received within the upper portion of the rail channel.

6. The kit of claim 1 in which each upright member of the plural panels is selectively tiltable with respect to the rails within an angular adjustment range.

7. The kit of claim 1 in which the web of the lower section of the bracket has a fastener opening formed therein.

8. A barrier comprising:

a plurality of posts;

a plurality of channel-shaped rails disposed in spaced and parallel relationship, each rail having a web and opposed side walls and extending between an adjacent pair of posts;

a plurality of brackets, each bracket connecting the end of a channel-shaped rail and a post and comprising:

a lower section formed from a pair of spaced first and second side walls interconnected by a web, the web and side walls cooperating to define a channel, the lower section having an upper end and a lower end; and an upper section partially received within the channel of the lower section and pivotably joined to the lower section at the upper end of the lower section, the upper section having opposed first and second side walls;

in which the first side walls of the upper and lower sections cooperate to define a first pocket, and the second side walls of the upper and lower sections cooperate to define a second pocket spaced from the first pocket, with each pocket sized to receive a side wall of a channel-shaped rail therein.

9. The barrier of claim 8 in which each rail is characterized as having a longitudinally extending ridge formed in each side wall so as to project within the rail channel, the ridges separating upper and lower portions of the rail channel, and in which the upper section of each bracket is sized to be clearingly received within the upper portion of the rail channel.

10. A barrier comprising:

a plurality of posts, each post embedded at its base within an underground substrate;

a plurality of channel-shaped rails disposed in spaced and parallel relationship, each rail having a web and opposed side walls and extending between an adjacent pair of said posts; and a plurality of brackets for securing each end of each rail to an adjacent post of said posts, each bracket comprising:

a lower section formed from a pair of spaced first and second side walls interconnected by a web, the web and side walls cooperating to define a channel, the lower section having an upper end and a lower end; and an upper section partially received within the channel of the lower section, longitudinally received within the channel of one of said rails, and pivotably joined to the lower section at the upper end of the lower section, the upper section having opposed first and second side walls;

in which the first side walls of the upper and lower sections cooperate to define a first pocket, and the second side walls of the upper and lower sections cooperate to define a second pocket spaced from the first pocket, with each pocket receiving a side wall of one of said rails therein.

11. The barrier of claim 10 in which the web of the lower section of each bracket is attached to one of said posts, and in which the channel of the lower section opens away from its associated post, in which the channel transversely receives at least a portion of one of said rails.

12. The barrier of claim 10 in which each of the rails is characterized as having a longitudinally extending ridge formed in each side wall so as to project within the rail channel, the ridges separating upper and lower portions of the rail channel, and in which the upper section of the bracket is clearingly received within the upper portion of the rail channel.

13. The barrier of claim 12 in which the side walls of the upper section of the bracket and projecting ridges of the rail cooperate to interfere with lifting of a rail from its associated bracket.

14. The barrier of claim 10 in which an externally projecting tab is formed in a side wall of the upper section, the tab adapted to interfere with longitudinal withdrawal of a rail from its associated bracket.

15. The barrier of claim 10 in which the upper and lower sections of the bracket are integral, and in which their junction comprises a bend in the material from which the bracket is formed.

16. The barrier of claim 10 further comprising:

a plurality of upright members, each upright member extending in transverse relationship to the plural rails and selectively tiltable with respect to the rails within an angular adjustment range.

17. The barrier of claim 10 in which the upper section is pivotable with respect to the lower section to conform to the slope of the terrain.

18. The barrier of claim 10 in which the web of the lower section of each bracket has a fastener opening formed therein.

* * * * *